US005513546A

United States Patent [19]

Ikeda et al.

[11] Patent Number: 5,513,546

[45] Date of Patent: May 7, 1996

[54] DEVICE FOR FASTENING AND LOOSENING THREADED MEMBERS

[75] Inventors: Seiji Ikeda, Osaka; Shinji Fukuhara, Hirakata, both of Japan

[73] Assignee: Maeda Metal Industries, Ltd., Japan

[21] Appl. No.: 306,831

[22] Filed: Sep. 15, 1994

[30] Foreign Application Priority Data

Oct. 22, 1993 [JP] Japan ..... 5-264431

[51] Int. Cl.[6] ..... B25B 21/00

[52] U.S. Cl. ..... 81/57.13; 81/55; 74/378

[58] Field of Search ..... 81/57.11–57.14, 81/57.22, 57, 57.24, 57.28–57.32, 54–55; 173/216, 217, 47; 74/378, 371; 192/96

[56] References Cited

U.S. PATENT DOCUMENTS

| | | | |
|---|---|---|---|
| 3,739,659 | 6/1973 | Workman, Jr. | 81/57.14 X |
| 3,818,855 | 6/1974 | Shimanckas | 74/378 X |
| 4,106,371 | 8/1978 | Akiyoshi et al. | 81/57.14 |
| 4,505,170 | 3/1985 | Van Laere | 81/57.14 |
| 4,653,338 | 3/1987 | Yeomans | 74/378 X |
| 5,110,312 | 5/1992 | Higby | 74/378 X |

*Primary Examiner*—D. S. Meislin

*Attorney, Agent, or Firm*—Pravel, Hewitt, Kimball & Krieger

[57] ABSTRACT

A device for fastening and loosening threaded members which has a socket mechanism at its forward end for engaging the threaded member and in which the torque of a motor rotatable in one direction is transmitted to the socket mechanism via a rotation transmission route including a planetary gear mechanism, forward-reverse rotation changing assembly and bevel gear mechanism. The bevel gear mechanism comprises a drive bevel gear coupled to the motor, and a pair of driven bevel gears opposed to each other in orthogonal relation to the axis of the drive gear and aligned with the axis of the planetary gear mechanism, the driven bevel gears being in mesh with the drive gear. The rotation changing assembly comprises an output shaft rotatably extending through the driven gears, and engaging means for selectively engaging one of the driven gears with the output shaft for the engaged gear to rotate with the shaft or disengaging the gear from the shaft. The output shaft is coupled to the planetary gear mechanism.

4 Claims, 7 Drawing Sheets

DEVICE FOR FASTENING AND LOOSENING THREADED MEMBERS

FIELD OF THE INVENTION

The present invention relates to a power-operated device which is usable for two kinds of work, i.e., for fastening and loosening threaded members such as hexagon headed bolts and nuts.

BACKGROUND ART

In devices adapted to perform two kinds of work, i.e., to fasten and loosen bolts and nuts, the change of direction of rotation from forward fastening rotation to reverse loosening rotation and vice versa is almost always effected by changing the direction of rotation of the motor itself.

Electric or pneumatic motors, which are generally used for fastening-loosening devices for bolts and nuts, include reversible motors and those rotatable in only one direction (nonreversible motors). When these two types of motors are compared on the basis of the same output level, the former is 20 to 30% larger than the latter and is also heavier. Nevertheless, reversible motors are used in almost all cases because this type of motors can be changed over in the direction of rotation only by manipulating a switch, hence a simplified construction.

The fastening-loosening device for bolts and nuts is heavy, imposes a great burden on the worker when used for a long period of time and therefore has a major problem in that the device must be reduced in weight.

As previously stated, the reversible motor is greater in size than the nonreversible motor at the same output level. Accordingly, use of the nonreversible motor is advantageous for reducing the weight of the device insofar as motors only are concerned.

When the nonreversible motor is to be incorporated into fastening-loosening devices, however, there arises a need to use a mechanism which permits forward and reverse rotations with the same characteristics and exhibits the same transmission efficiency for forward and reverse rotations.

Conventionally available as means fulfilling these requirements is a rotation changing assembly wherein bevel gears are used. This assembly comprises two driven bevel gears slidably arranged as opposed to each other on a common axis orthogonal to the axis of a drive bevel gear coupled to a motor. One of the driven bevel gears is selectively meshed with the drive gear for transmitting a torque to a socket mechanism via the driven gear and a planetary gear mechanism.

For either one of the driven bevel gears to be selectively engaged with and disengaged from the drive bevel gear, the above bevel gear assembly needs to have a mechanism for slidingly driving the driven bevel gear which mechanism is disposed outside the bevel gears. The casing of the fastening-loosening device then becomes increased in size to provide a space for accommodating the mechanism and a space for permitting the sliding movement of the driven bevel gear. The increase in the size of the casing and the weight of the mechanism for slidingly driving the bevel gear inevitably increase the size and weight of the entire device although the nonreversible motor is used.

The present invention provides a device for fastening and loosening threaded members wherein one of a pair of driven bevel gears which are in mesh with a drive gear at all times is selectively engageable with an output shaft for a change-over to forward rotation or to reverse rotation so as to lessen the increase of size and weight.

SUMMARY OF THE INVENTION

The present invention provides a device for fastening and loosening threaded, members which has a socket mechanism at its forward end for engaging the threaded member and in which the torque of a nonreversible motor is transmitted to the socket mechanism by way of a rotation transmission route including a planetary gear mechanism, forward-reverse rotation changing assembly and bevel gear mechanism. The bevel gear mechanism comprises a drive bevel gear coupled to the motor, and a pair of driven bevel gears opposed to each other in orthogonal relation to the axis of the drive bevel gear and arranged on an extension of the axis of the planetary gear mechanism, the pair of driven bevel gears being in mesh with the drive bevel gear. The rotation changing assembly comprises an output shaft rotatably extending through the pair of driven bevel gears, and enagaging means for selectively engaging one of the driven bevel gears with the output shaft for the engaged gear to rotate with the shaft or disengaging the gear from the shaft, the output shaft being coupled to the planetary gear mechanism.

DESCRIPTION OF EMBODIMENT

Construction

Figure 1:
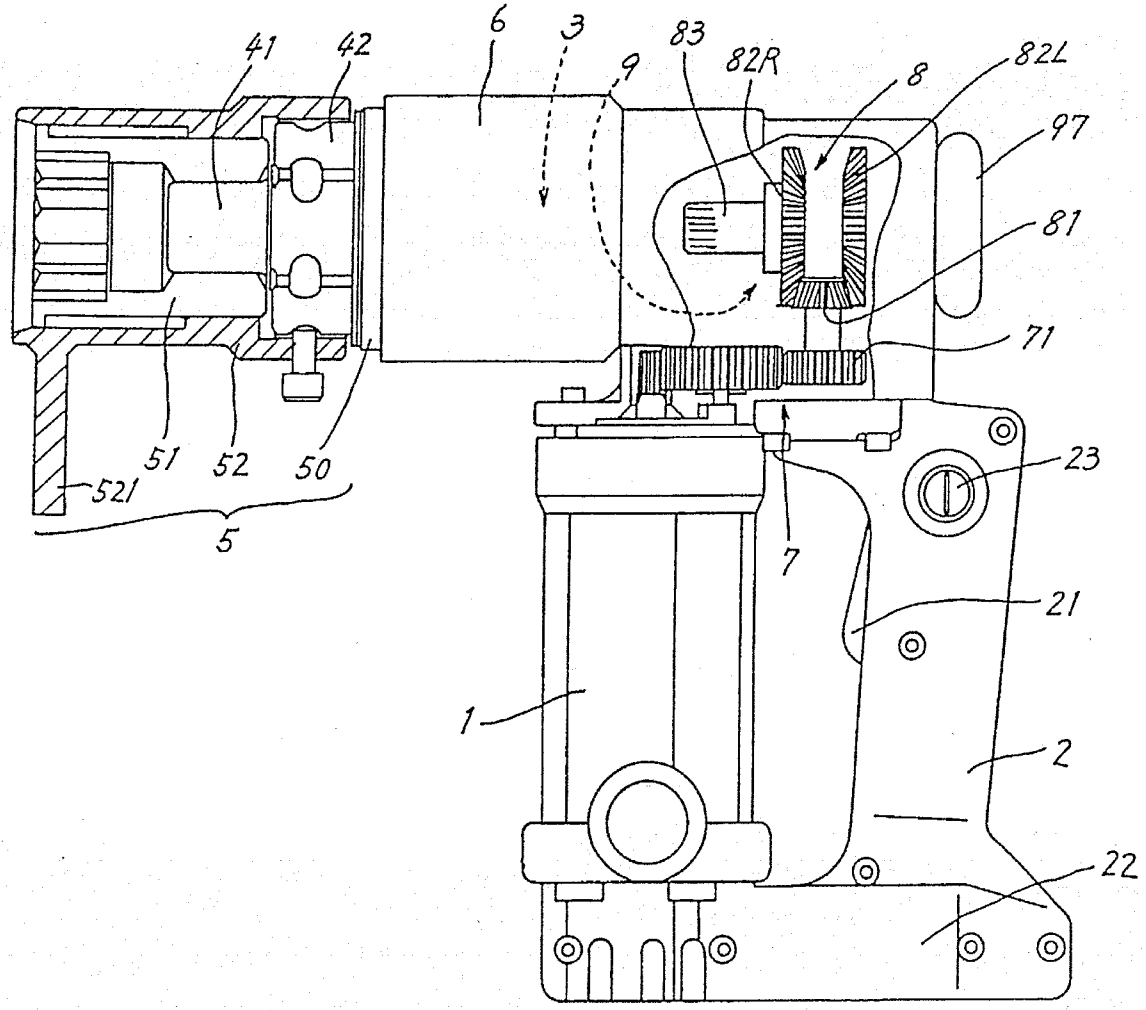
FIG. 1 is an overall view partly broken away and showing a device of the invention for fastening and loosening threaded members.

FIG. 1 shows an embodiment of the present invention which is a device for performing two kinds of work, i.e., for fastening and loosening threaded members such as bolts and nuts.

A planetary gear mechanism 3 of a plurality of stages is accommodated in the housing 6. The housing 6 is provided with a socket mechanism 5 at its forward end, a motor 1 rotatable in one direction (nonreversible motor) and disposed perpendicular to the axis of the housing 6 at the midportion thereof, and a handle 2 projecting from the base end of the housing 6 approximately in parallel to the motor 1.

An inner output shaft 41 extends from a planetary gear support frame (not shown) of the final stage of the planetary gear mechanism. An outer output shaft 42 is in mesh with an internally toothed gear 50 of the gear mechanism 3.

The inner output shaft 41 loosely extends through the outer output shaft 42.

The socket mechanism 5 comprises a socket 51 adapted to drive a bolt, nut or like threaded member and removably engaged with the inner output shaft 41, and an anti-reaction member 52 having a lever 521 and removably attached to the outer output shaft 42.

The nonreversible motor 1 is designed to give a maximum output in the single direction of rotation by incorporating technical means which are not usable in reversible motors, such as a twisted inner winding and a propeller fan for achieving an improved cooling efficiency.

When required, the motor 1 has connected thereto a control circuit 22 for controlling the motor 1 so as to stop the rotation of the motor upon the fastening torque reaching a predetermined value.

The handle 2 is provided with an operating switch 21 and a dial 23 for setting a control torque value.

Considering that the fastening-loosening device is used as directed upward, downward, sidewise or in any other position, the worker will be less burdened on his wrist if the center of gravity of the device is positioned closer to the handle 2.

To position the center of gravity of the fastening-loosening device close to the handle 2 according to the present embodiment, a forward-reverse rotation changing assembly 9 utilizing a bevel gear mechanism 8 is provided toward the base end of the housing 6. The motor 1 is coupled to the bevel gear mechanism 8 via a train 7 of spur gears.

The bevel gear mechanism 8, planetary gear mechanism 3 and socket mechanism 5 are arranged closer to the handle 2 by a distance corresponding to the spur gear train 7 to position the center of gravity of the device closer to the handle 2, so that the device can be held in good balance.

The spur gear train 7 includes a gear 71 of its terminal stage which has a drive bevel gear 81 projecting therefrom. A pair of driven bevel gears 82R, 82L are opposed to each other in orthogonal relation with the axis of the drive bevel gear 81 and arranged in alignment with the axis of the planetary gear mechanism 3. The gears 82R, 82L are in mesh with the drive bevel gear 81 to provide the bevel gear mechanism 8.

Figure 2:
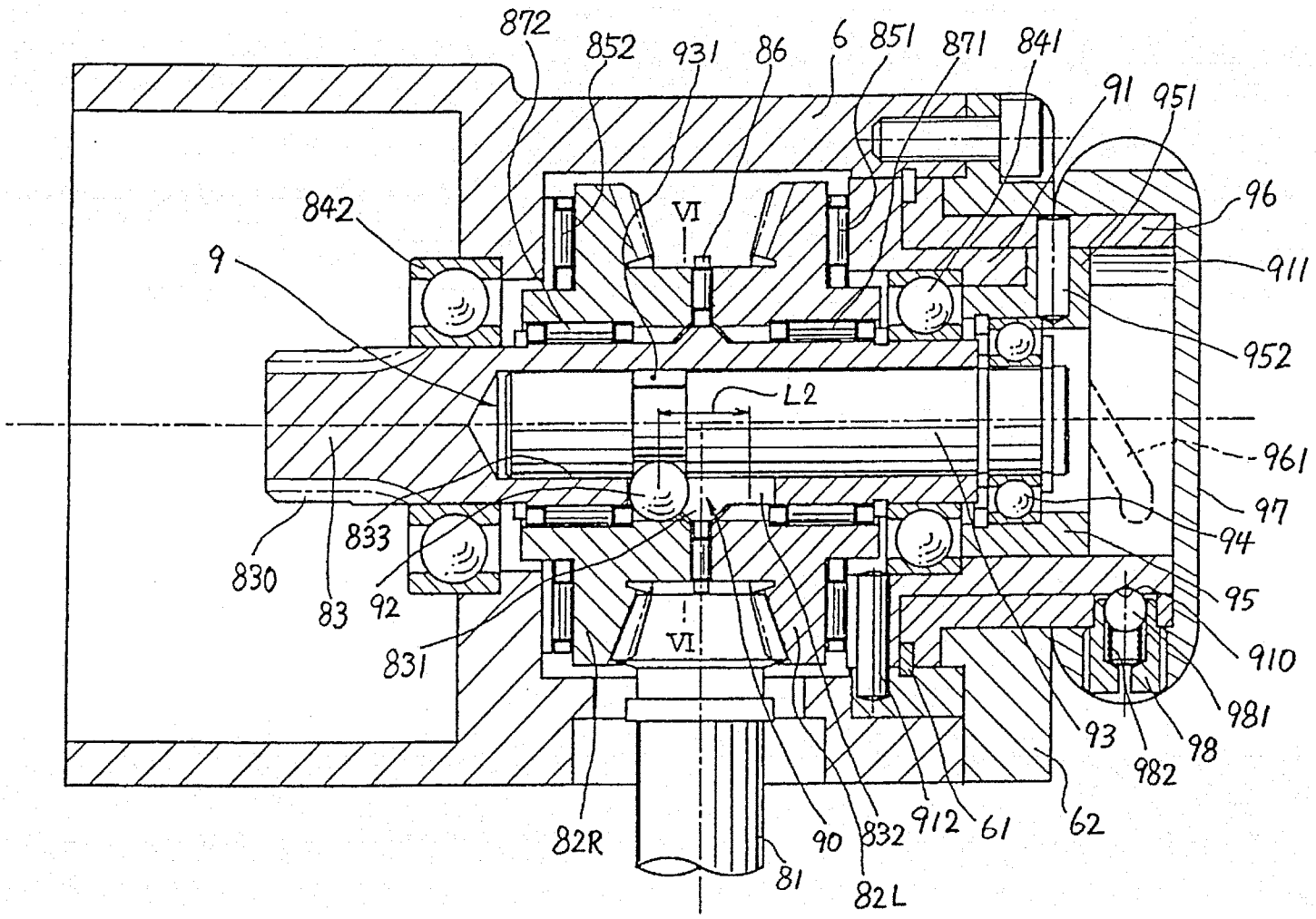
FIG. 2 is a sectional view of a forward-reverse rotation changing assembly of the invention.

With reference to FIG. 2, the forward-reverse rotation changing assembly 9 comprises an output shaft 83 incorporated into the driven bevel gears 82R, 82L, and engaging means 90 for selectively engaging one of the gears 82R, 82L with the output shaft 83 and disengaging the gear from the shaft. The main components of the rotation changing assembly 9 are arranged on the axis of the driven bevel gears 82R, 82L.

The output shaft 83 rotatably extends through the axis of the gears 82R, 82L. The shaft 83 has a base end supported by a radial bearing 841 and spool guide 91 (to be described later) on the housing 6, and a forward end portion supported by a bearing 842 on the housing 6. The forward end of the output shaft 83 is made into a pinion 830, which serves as a sun gear of the planetary gear mechanism in its initial stage.

More specifically, the driven bevel gears 82R, 82L are rotatably supported by needle bearings 871, 872 interposed between the output shaft 83 and these gears, a thrust needle bearing 86 between the gears 82R, 82L and thrust needle bearings 851, 852 arranged on the rear faces of these gears in contact therewith, and are restrained from moving axially of the shaft 83 by these bearings.

With the present embodiment, the driven bevel gear 82R toward the planetary gear mechanism 3 rotates in the direction of fastening threaded members (clockwise direction), and the other driven bevel gear 82L rotates in the direction of loosening the threaded member (counterclockwise direction).

The rotation in the fastening direction will herein be referred to as "forward or clockwise rotation," and the rotation in the loosening direction as "reverse or counteclockwise rotation."

Figure 3A:
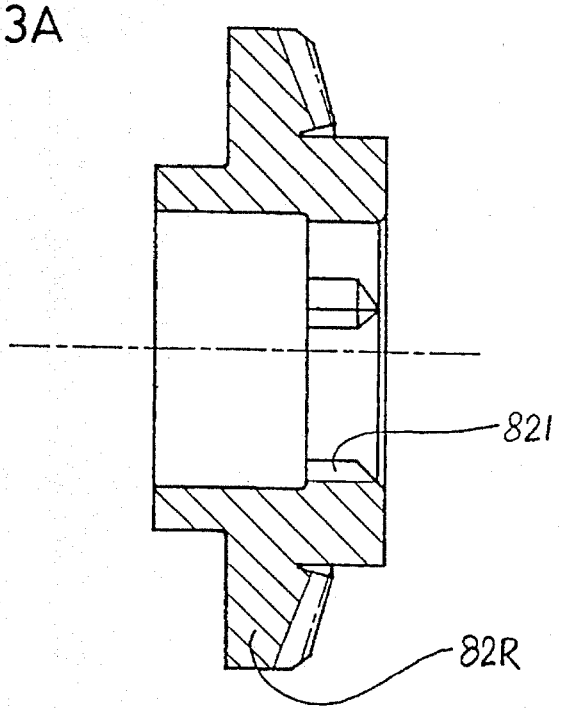
FIG. 3A is a sectional view of a driven gear for clockwise rotation.
Figure 3B:
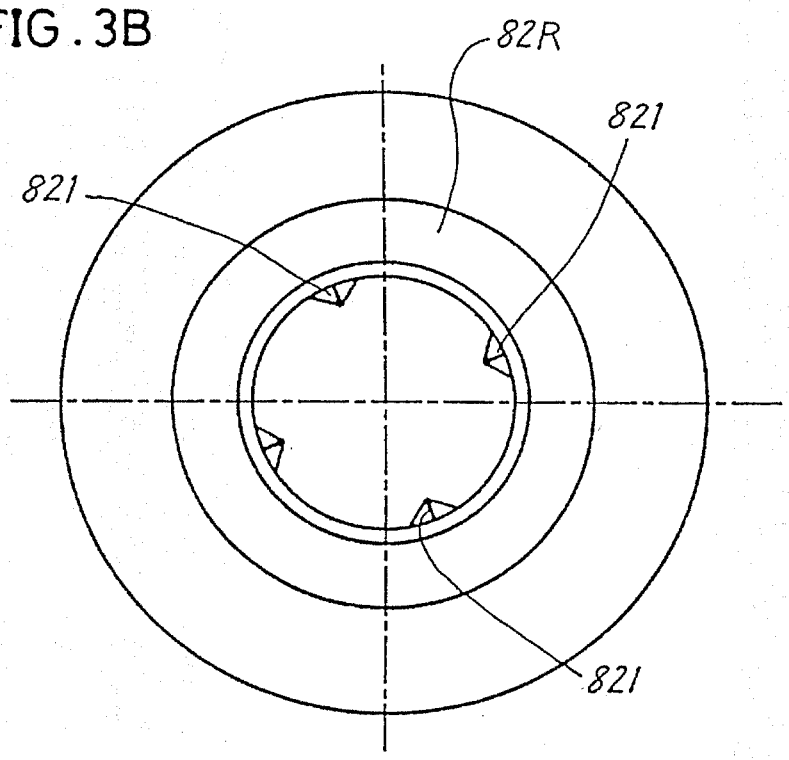
FIG. 3B is a plan view of the driven gear of FIG. 3A.

With reference to FIGS. 3A and 3B, the driven bevel gear 82R is formed, on an inner face of one side thereof opposed to the other driven gear 82L, with a plurality of (e.g., four in the present embodiment) axial ridges 821 equidistantly spaced apart circumferentially thereof. Similarly, the driven bevel gear 82L has four axial ridges which are formed on an inner face of one side thereof opposed to the gear 82R and which are equidistantly spaced apart circumferentially thereof.

Referring to FIGS. 2and 5B, the output shaft 83 is formed on its outer periphery with a circumferential wall 831 having fitted therearound the thrust needle bearing 86 between the driven bevel gears 82R, 82L. The shaft 83 has a guide bore 833 coaxial therewith and extending from its base end face toward the forward end thereof. The output shaft 83 is further formed in its peripheral wall with groovelike cutouts 832 axially extending across the circumferential wall 831 and communicating with the guide bore 832. The cutouts 832 correspond in number to the ridges 821 on the inner face of each of the driven bevel gears 82R, 82L and are equidistantly spaced apart circumferentially of the shaft 83.

Figure 5A:
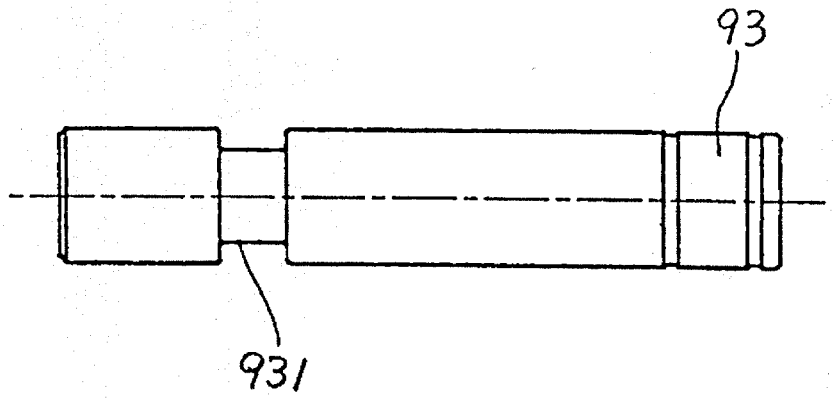
FIG. 5A is a front view of a spool.
Figure 5B:
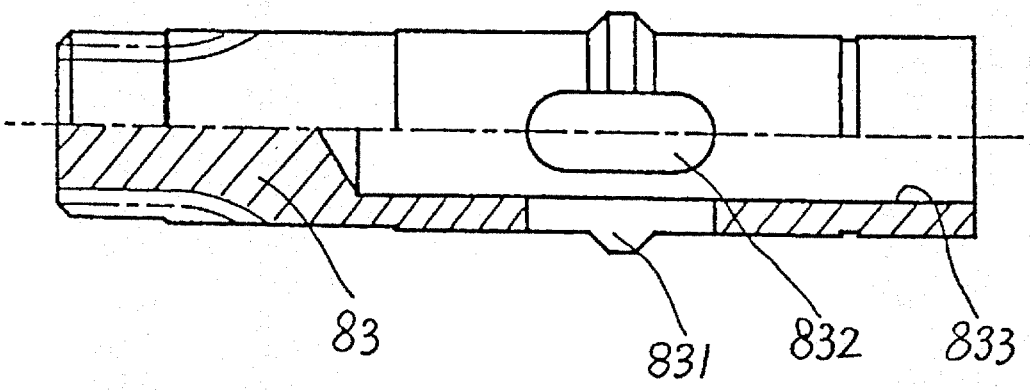
FIG. 5B is a front view of an output shaft.
Figure 6:
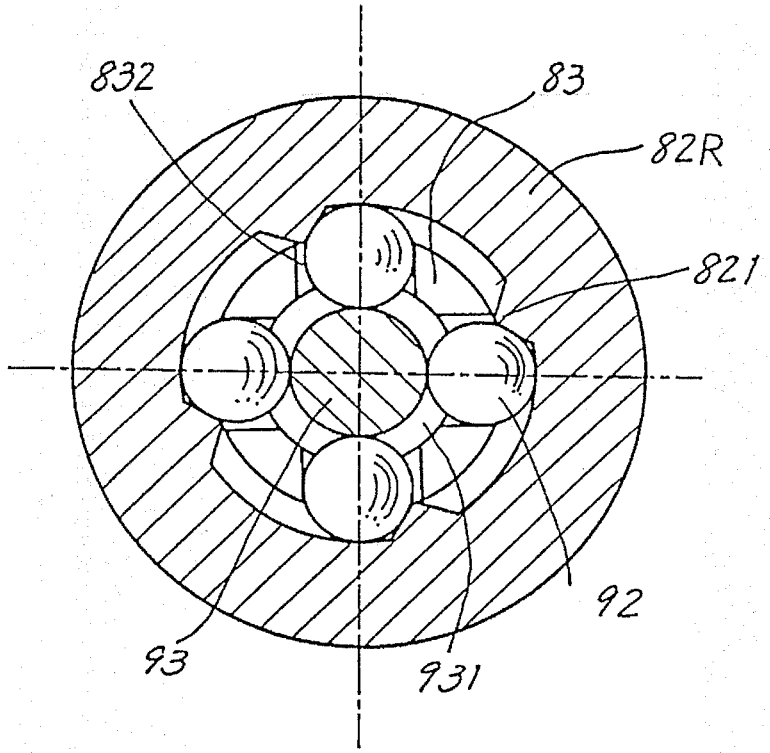
FIG. 6 is a view in section taken along the line VI—VI in FIG. 2.

A spool 93 is slidably inserted in the guide groove 833 of the output shaft 83. The spool 93 has a circumferential groove 931 positioned toward the pinion 83 (see FIG. 5A).

Balls 92 rollably fitting in the respective cutouts 832 of the output shaft 83 partly project from the circumferential groove 931 of the spool 93 and are restrained by the groove 931 from moving axially of the spool 93. The balls 92 further partly project beyond the outer periphery of the output shaft 83 so as to be engageable with the respective ridges 821 on the inner face of the driven bevel gear 82R or 82L.

The spool 93, when moved axially, forcibly moves the balls 92 to a position where they are engageable with the respective ridges 821 of either one of the driven bevel gears 82R, 82L.

When the spool 93 is in a neutral position, the balls 92 are in an intermediate position between the two driven bevel gears 82R, 82L and remain out of engagement with the ridges 821 of the driven bevel gears 82R, 82L.

The spool 93 is held at its base end by a tubular spool holder 95 with a bearing 94 provided between the spool and the holder, and is restrained from moving axially relative to the holder. The spool holder 95 is held within a tubular spool guide 91.

The spool holder 95 has projections 951 each with a pin 952 projecting therefrom. The spool holder 95 and the spool guide 91 are prevented from rotating relative to each other by the projections 951 of the holder 95 each slidably fitting in a long groove 911 (see FIG. 4C) formed in the spool guide 91 axially thereof.

The spool guide 91 is held to the housing 6 by a pin 912 and a snap ring 61.

Rotatably fitting around the spool guide 91 is a tubular change drum 96 prevented from slipping off from the spool guide 91 and the housing 6 by a housing cover 62.

Figure 4A:
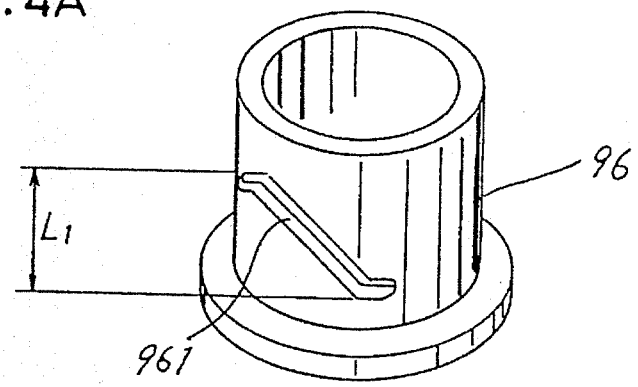
FIG. 4A is a perspective view of a change drum.
Figure 4B:
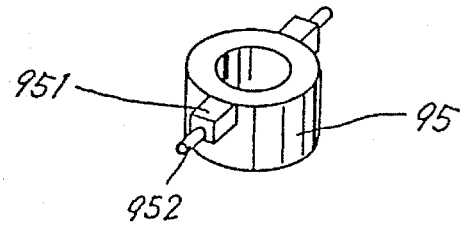
FIG. 4B is a perspective view of a spool holder.
Figure 4C:
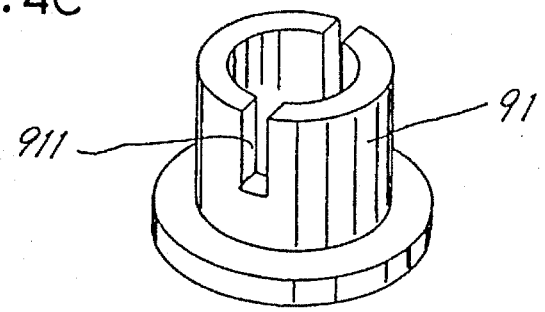
FIG. 4C is a perspective view of a spool guide.

FIG. 4A shows the change drum 96. The drum is formed with a slanting groove 961 having the pin 952 of the spool holder 95 slidably fitted therein. The shortest axial distance L1 between opposite ends of the slanting groove 961 corresponds to the distance L2 from the position where the balls 92 engage with the respective ridges 821 of one of the driven bevel gears, 82R, to the position where the balls engage with the ridges 821 of the other driven bevel gear 82L.

Each end of the slanting groove 961 extends a short distance circumferentially of the drum so as to position the spool 93 in place with improved accuracy after its movement.

A changed grip 97 is fastened to one end of the change drum 96 with a screw 98.

The screw 98 is provided with a steel ball 981 biased by a spring 982 into contact with the periphery of the change drum 96 at all times.

The spool guide 91 has a conical cavity 910 formed in its periphery for the steel ball 981 to fit in to softly engage the spool guide 91 at a position where the pin 952 of the spool holder 95 reaches each end of the slanting groove 961 in the change drum 96.

The change grip 97 bears on its surface a mark (such as an arrow) indicating the rotated position of the grip, while the end face portion of the housing 6 around the grip 97 is marked with an indication showing the direction of rotation, such as clockwise rotation (R) or counterclockwise rotation (L).

The change grip 97, change drum 96, spool guide 91, spool holder 95, spool 93 and balls 92 constitute the engaging means 90 for selectively engaging one of the driven bevel gears 82R, 82L with the output shaft 83 as will be described below.

Description of Fastening Procedure and Operation

The mark on the change grip 97 is set to the clockwise rotation (fastening direction), and the torque setting dial 23 is set to a target torque value.

Figure 7A:
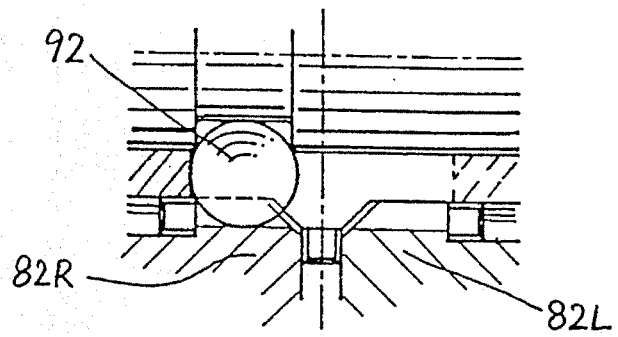
FIG. 7A to FIG. 7C are diagrams for illustrating rotation change-over movements.

When the change grip 97 is set to the clockwise direction, the change drum 96 also rotates, guiding the pin 952 by the slanting groove 961 and causing the spool holder 95 to push the spool 93 and the balls 92 toward the socket mehanism 5 to position the balls 92 for engagement with the ridges 821 on the driven bevel gear 82R rotatable in the fastening direction (see FIG. 7A).

When the change grip 97 is set in position for clockwise rotation by turning, the steel ball 981 resiliently engages in the conical cavity 910 under the action of the spring 982 to hold the change grip 97 in position with a small force.

With the handle 2 of the fastening-loosening device held by hand, the socket 51 is engaged with a bolt, nut or like threaded member, and the lever 521 of the anti-reaction member 52 is caused to bear against an adjacent member. The switch 21 is then turned on, whereupon the motor 1 rotates, causing the spur gear train 7 to rotate the drive bevel gear 81. The drive bevel gear 81, meshing with the pair of driven bevel gears 82R, 82L, rotates the gear 82R clockwise and the gear 82L counterclockwise.

When the drive gear 81 rotates these bevel gears 82R, 82L, a torque and repulsion act on the gears 82R, 82L to exert a tilting force on the rotary shaft, whereas the gears 82R, 82L lightly and smoothly rotate because the loads involved are dividedly withstood by the bearings, i.e., the needle bearings 871, 872 which bear the radial load and the thrust needle bearings 851, 852, 86 which bear the thrust load.

These needle bearings 871, 872 and thrust needle bearings 851, 852, 86 are compactly incorporated in the inside or in the vicinity of the driven bevel gears 82R, 82L serving as power transmission components without giving an increased size to the forward-reverse rotation changing assembly 9.

The output shaft 83 coupled to the driven bevel gear 82R for fastening rotation by the balls 92 which are in engagement with the shaft and the bevel gear is rotated with the gear 82R by the rotation of the gears 82R, 82L. The other driven gear 82L merely rotates idly.

The output shaft 83 to which a torque is transmitted operates the planetary gear mechanism 3, which amplifies the input to a required torque and delivers the torque to the inner output shaft 41 and the outer output shaft 42 as torques of opposite directions. The inner output shaft 41 drivingly rotates the socket 51 in engagement therewith, while the anti-reaction member 52 causes an adjacent member to bear the resulting reaction.

When the threaded member has been fastened with a required torque by the rotation of the socket 51, the control circuit 22 provided inside the handle 2 operates to turn off the power source and stop the rotation of the motor 1, whereby the fastening operation is completed.

Description of Loosening Procedure and Operation

A description will be given of a case wherein the device is changed over from the fastening operation to a loosening operation.

Figure 7B:
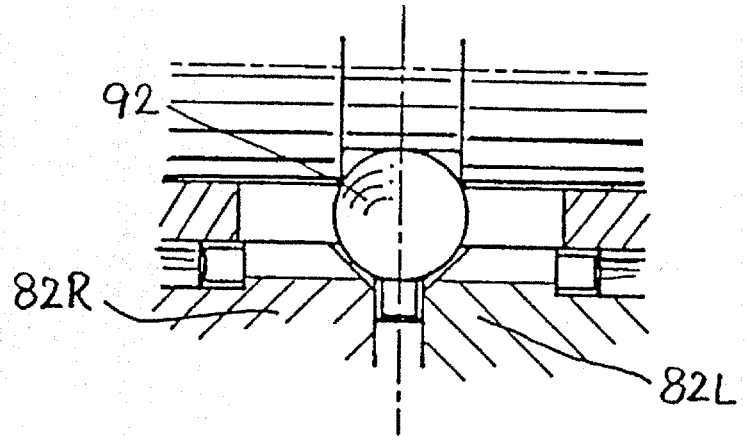

The change grip 97 is turned from the forward rotation position toward the reverse rotation position. The pin 952, i.e., the spool holder 95, moves toward the housing cover 62 along the slanting groove 961. With this movement, the spool 93 also moves, whereby the balls 92 fitting in and restrained by the circumferential groove 931 are also moved, released from engagement with the ridges 821 of the driven bevel gear 82R and brought to the position of the circumferential wall 831 which is provided approximately at the midportion of the output shaft 83 to block torque transmission to both the forward rotation side and the reverse rotation side (see FIG. 7B).

Figure 7C:
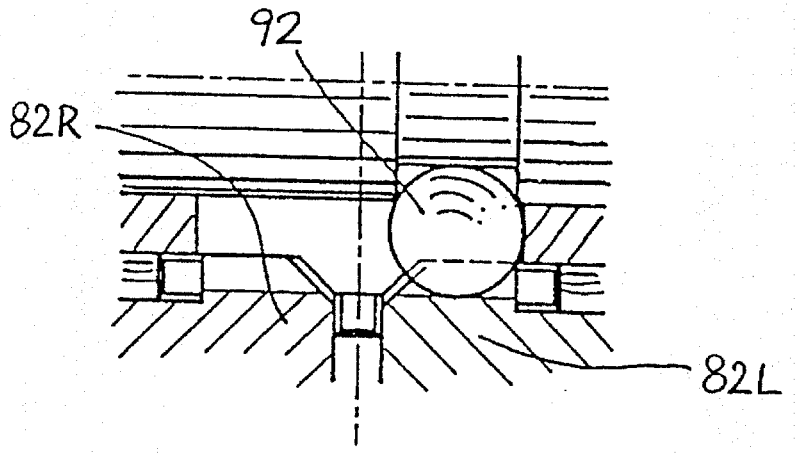

The change grip 97 is further turned and reaches the position of the indication of the final position, i.e., reverse rotation position, whereby the balls 92 are brought to the position of engagement with the ridges 821 of the driven bevel gear 82L closer to the change grip 97 (see FIG. 7C).

At this time, the change grip 97 is held in position with a small force by the steel ball 981 in the same manner as previously described.

The driven bevel gear 82L for reverse rotation, which was idly rotating during fastening, is coupled by the balls 92 to the output shaft 83. The shaft 83 rotates with the driven bevel gear 82L, with the positive rotation driven bevel gear 82R in idle rotation.

Through the same procedure as the fastening procedure, the threaded member can be loosened with exactly the same torque value as in the fastening operation by the fastening-loosening device thus changed over in the direction of rotation.

Advantages

The arrangement wherein the pair of driven bevel gears 82R, 82L are in mesh with the drive bevel gear 81 at all times eliminates the need for the conventional mechanism by which one of the gears 82R, 82L is slidingly moved into and out of meshing engagement with the drive bevel gear selectively.

This obviates the need to provide a space for accommodating the mechanism and a space for the sliding movement of the gears 82R, 82L, consequently compacting the fastening-loosening device.

The pair of driven bevel gears 82R, 82L meshing with the driven bevel gear 81 and arranged on the same axis as opposed to each other rotate in directions opposite to each other, so that the direction of rotation can be changed merely by selectively engaging one of the driven bevel gears 82R, 82L with the output shaft 83 rotatably extending through these gears 82R, 82L.

Further the means 90 for engaging the gear 82R or 82L with the output shaft 83 can be arranged on the output shaft 83. Since the nonreversible motor is smaller in size and weight than the reversible motor when these motors are equivalent in output, the fastening-loosening device can be less increased in its size and weight and made convenient to use to achieve an improved work efficiency.

The electric motor of the embodiment is a little over 1 kg in weight, while the fastening-loosening device weighs about 5 kg in its entirety. If this motor is replaced by a reversible motor, there arises a need to consider the weight balance, mount member, etc. in addition to the weight increase of the motor itself, with the result that the weight of the entire fastening-loosening device increases by as much as more than 10%. When simply considered, this weight increase does not appear very great, whereas it will not be beyond comprehension how heavily the device will burden the worker if the device is held by hand and used all day long for fastening work.

The present invention has been described above with reference to the device for fastening and loosening threaded members. However, when the inner and outer output shafts 41, 42 are left exposed with the socket mechanism 5 removed from the present device, the device is of course usable as a drive source for various mechines or tools which have a socket engageable with the output shaft.

The present invention is not limited to the construction of the foregoing embodiment but can be modified variously within the scope thereof as defined in the appended claims.

What is claimed is:

1. A device for fastening and loosening threaded members comprising:

a motor rotatable in the one direction, a drive bevel gear coupled to the motor, a pair of driven bevel gears arranged as opposed to each other in orthogonal relation to the axis of the drive bevel gear and meshing with the drive bevel gear, an output shaft rotatably extending through the driven bevel gears and having a guide bore and cutouts formed in it, means for selectively engaging one of the pair of driven bevel gears with the output shaft to rotate the shaft with the engaged gear or disengaging the gear from the shaft, the engaging means comprising:

a spool having a circumferential groove in its outer periphery and slidably disposed in the guide bore of the output shaft, balls rollably fitting in the cutouts of the output shaft and engageable in the circumferential groove of the spook, the balls projecting beyond the output shaft so as to be engageable with either of the driven bevel gears, a spool guide formed with an axial groove and held to the housing, a spool holder provided with a projection having a pin and slidably fitting in the groove of the spool guide, the spool holder being retained in the spool guide so as not to be rotatable relative to the spool guide, a tubular change drum rotatably fitting around the spool guide and formed with a slanting groove having the pin of the spool holder slidably fitted therein, and a change grip attached to one end of the change drum, a planetary gear mechanism coupled to the output shaft, and a socket mechanism coupled to the planetary gear mechanism for engaging the threaded member, the engaging means being operable to subject the torque of the motor to a changeover to forward rotation or reverse rotation by selectively engaging one of the driven bevel gears with the output shaft.

2. A device as defined in claim 1 wherein the output shaft has a base end supported by a radial bearing and a forward end supported by a radial bearing on the housing, the driven bevel gears being rotatably supported on the output shaft by a first and a second needle bearings interposed between the output shaft and the driven bevel gear, a first thrust needle bearing disposed between the driven bevel gears and a second and a third thrust needle bearings disposed in contact with a rear face of the driven bevel gear, and prevented from moving axially thereof by the needle bearings.

3. A device as defined in claim 2 wherein each of the driven bevel gears is formed on an inner face of one side thereof opposed to the other driven bevel gear with a plurality of axial ridges equidistantly spaced apart circumferentially thereof, and the output shaft is formed on its outer periphery with a circumferential wall having fitted therearound the thrust needle bearing between the driven bevel gears, and the output shaft guide bore is formed coaxially and extending from its base and end face toward the forward end thereof and the output shaft cutouts are formed as grooves extending through its peripheral wall to the guide bore and corresponding to the ridges, the output shaft cutouts extending axially of the shaft across the circumferential wall and being equidistantly spaced apart circumferentially of the shaft.

4. A device as defined in claim 1 wherein the drive bevel gear is coupled to the motor by a train of spur gears.

* * * * *